US006149460A

United States Patent [19]

Straeb et al.

[11] Patent Number: 6,149,460

[45] **Date of Patent: *Nov. 21, 2000**

[54] RF PLUG CONNECTION SYSTEM AND METHOD FOR ASSEMBLING THE RF PLUG CONNECTION SYSTEM

[75] Inventors: Martin Straeb, Diessen, Germany; Jan Dessin, Blankenberge, Belgium; Edgard Acke, Oostkamp, Belgium; Joris Dobbelaere, Beernem, Belgium; Dimitri Meulemeester, Torhout, Belgium

[73] Assignee: Tyco Electronics Logistics AG, Steinach, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 09/160,865

[22] Filed: Sep. 25, 1998

[51] Int. Cl.[7] ..... H01R 9/05

[52] U.S. Cl. ..... 439/578; 439/394

[58] Field of Search ..... 439/394, 581, 439/63, 417, 578, 411, 675, 668, 519, 521, 887, 879

[56] References Cited

U.S. PATENT DOCUMENTS

| | | | |
|---|---|---|---|
| 4,626,058 | 12/1986 | Prince et al. | 439/579 |
| 4,759,722 | 7/1988 | Song | 439/394 |
| 4,822,288 | 4/1989 | Conley | 439/887 |
| 4,927,378 | 5/1990 | Song | 439/394 |
| 5,076,799 | 12/1991 | Virgo | 439/394 |
| 5,569,049 | 10/1996 | Tatebe et al. | 439/394 |
| 5,735,711 | 4/1998 | Freingen | 439/521 |
| 5,749,756 | 5/1998 | Vockroth et al. | 439/879 |

FOREIGN PATENT DOCUMENTS

| | | | |
|---|---|---|---|
| 0 419 038 A1 | 3/1991 | European Pat. Off. . | |
| 0 607 485 A1 | 7/1994 | European Pat. Off. . | |
| 1109914 | 4/1968 | United Kingdom | 439/394 |

*Primary Examiner*—Paula Bradley
*Assistant Examiner*—Tho D. Ta
*Attorney, Agent, or Firm*—Herbert L. Lerner; Laurence A. Greenberg; Werner H. Stemer

[57] ABSTRACT

An RF plug connection system includes a contact part which can preferably be crimped to an RF conductor in an RF cable, an insulating part that holds the contact part, at least one insulation-piercing terminal contact holder which can be disposed on the RF cable and an intermediate housing which holds and preferably guides the insulation-piercing terminal contact holder. The insulation-piercing terminal contact holder has at least one blade which makes contact with an outer conductor of the RF cable when the insulation-piercing terminal contact holder is pressed against the RF cable. An outer housing is fitted over the intermediate housing. A method for assembling the RF plug connection system includes stripping insulation from an RF conductor of an RF cable, preferably crimping an exposed conductor to a contact part, inserting the contact part into an insulating part in an intermediate housing, placing the insulation-piercing terminal contact holder on the RF cable, applying pressure to the insulation-piercing terminal contact holder so that its blade cuts through the insulation of the RF cable and makes contact with the outer conductor, and fitting a preferably two-part outer housing.

20 Claims, 12 Drawing Sheets

RF PLUG CONNECTION SYSTEM AND METHOD FOR ASSEMBLING THE RF PLUG CONNECTION SYSTEM

BACKGROUND OF THE INVENTION

Field of the Invention

The present invention relates in general to an RF plug connection system, and in particular to a radio-frequency plug connection system which can be used in motor vehicles, as well as to a method for assembling the RF plug connection system.

Previously known connection systems for two RF cables include metallic plugs, the use of which involves considerable assembly effort. The cables to be connected must have the insulation (sheaths) stripped off 3 times, the cables must be fitted in place, the inner conductor must be soldered, the outer conductor must be beaded over, the cables must be passed through the plug housing, and finally contact must be made by the insertion of a retaining part.

Furthermore, another known connector for coaxial cables is disclosed in German Patent DE 36 88 284 C, corresponding to U.S. Pat. No. 4,701,001. That connector is illustrated in FIGS. 1 and 2 and described in detail below. Even that prior art device requires a number of assembly steps, and the stripping of the insulation of the outer sheathing is unavoidable.

The disadvantages of the known connectors for RF cables may be regarded as being that too many assembly steps are required and the complete stripping of the insulation on the coaxial cables involves considerable effort which, in turn, creates fault sources, such as damage to the shield when the insulation of the outer sheath is being stripped off.

SUMMARY OF THE INVENTION

It is accordingly an object of the invention to provide an RF plug connection system and a method for assembling the RF plug connection system, which overcome the hereinafore-mentioned disadvantages of the heretofore-known devices and methods of this general type and in which the RF plug connection system can be assembled as easily as possible and nevertheless ensures a reliable connection.

With the foregoing and other objects in view there is provided, in accordance with the invention, an RF plug connection system, comprising a contact part to be electrically conductively fitted to an RF conductor of an RF cable; an insulating part holding the contact part; an intermediate housing; at least one insulation-piercing terminal contact holder to be disposed on the RF cable and held by the intermediate housing, the insulation-piercing terminal contact holder having at least one blade making contact with an outer conductor of the RF cable when the insulation-piercing terminal contact holder is pressed against the RF cable; and an outer housing disposed on the intermediate housing.

This structure of the RF plug connection system ensures easy assembly, on one hand allowing the RF cable to be prefabricated with the contact parts, and on the other hand providing very easy assembly by applying pressure to the insulation-piercing terminal contact holder.

In accordance with another feature of the invention, the contact part, the insulating part and the insulation-piercing terminal contact holder are prelatched or prefitted in the intermediate housing.

In accordance with a further feature of the invention, the contact part is crimped to the RF conductor, although other types of attachment which ensure an electrical connection are also possible.

In accordance with an added feature of the invention, in order to ensure that pressure is applied to the insulation-piercing terminal contact holder in a stable and uniform manner, two insulation-piercing terminal contact holders are provided and are preferably disposed on opposite sides of the RF cable.

In accordance with an additional feature of the invention, in order to further improve the uniformity of the application of pressure, the insulation-piercing terminal contact holders are guided in the intermediate housing and preferably a plurality of blades are provided for this purpose and as an alternative manner of ensuring that the electrical connection is made.

In accordance with yet another feature of the invention, the contact part is constructed to be stepped, so that exact positioning can be achieved.

In accordance with yet a further feature of the invention, the stepped contact part is inserted into the correspondingly stepped insulating part in such a way that it is easy to position the contact part in a predetermined manner.

In accordance with yet an added feature of the invention, the contact part is centered in the insulating part, so that the contact part is likewise centered with respect to the outer housing which is fitted, ready-made, later.

In accordance with yet an additional feature of the invention, the insulation-piercing terminal contact holders have at least one blade with a U-shaped cross section, thus reliably ensuring that the blades can cut into the outer insulation of the RF cable, with the free ends of the U-shaped blade first of all cutting into the insulation, and the remaining sections of the blade engaging thereafter, when further pressure is applied. The fact that the free ends (small contact area) of the blade engage first, ensures that only a small amount of force need be applied.

In accordance with again another feature of the invention, the insulation-piercing terminal contact holders include at least one, but preferably a plurality of, latching elements which engage with corresponding latching openings on the intermediate housing. Prelatching of these components and thus further prefabrication are possible through appropriate configuration of the latching elements and the latching openings, as a result of which assembly is further simplified.

In accordance with again a further feature of the invention, when pressure is applied to the insulation-piercing terminal contact holders, each latching element engages successively in a plurality of latching openings in the fitting direction of the intermediate housing, and the latching openings are disposed virtually at right angles to the axis of the RF cable. The linear guidance of the insulation-piercing terminal contact holders ensures exact application of pressure, and thus a reliable connection for the outer conductor of the RF cable.

In accordance with again an added feature of the invention, there is provided a shielding plate in the form of a half-cylindrical sheath disposed on the insulation-piercing terminal contact holders and enclosing the contact part in the form of a cylindrical sheath in the assembled state, so that a shielding effect of the outer conductor is achieved.

In accordance with again an additional feature of the invention, in order to further simplify assembly, the outer housing is constructed in two parts, and the two parts of the housing can be engaged with one another through the use of a latching system, so that no tool is required for final assembly or housing assembly.

In accordance with still another feature of the invention, since the RF plug connection system is preferably used in motor vehicles, the insulating part, the intermediate housing and the outer housing are manufactured from plastic, in order to save weight.

In accordance with still a further feature of the invention, in order to make it possible to connect a number of cables at the same time, as is relatively frequently the case in the motor vehicle sector, a plurality of RF cables can be accommodated alongside one another in one outer housing.

With the objects of the invention in view there is also provided a method for assembling an RF plug connection system, which comprises stripping insulation from an RF cable to expose an RF conductor in the RF cable; electrically connecting the exposed conductor to a contact part; fitting the contact part into an insulating part in an intermediate housing; in the process placing at least one insulation-piercing terminal contact holder with at least one blade in the intermediate housing on the RF cable; applying pressure to the insulation-piercing terminal contact holder causing the at least one blade to cut through the insulation of the RF cable and make contact with an outer conductor of the RF cable; and fitting an outer housing over the intermediate housing.

Accordingly, all that is required for assembly is one stripping tool for the RF conductor as well as, preferably, crimping pliers for the contact part, while the rest of the assembly process is carried out without the assistance of tools.

In accordance with another mode of the invention, the contact part is inserted centrally into the insulating part through the use of corresponding steps on the two parts, so as to ensure that the position is fixed exactly.

In accordance with a further mode of the invention, in order to ensure that contact with the outer conductor is made reliably, the insulation-piercing terminal contact holder or holders is or are guided through the use of at least one and preferably a plurality of latching elements which are formed on them and engage with corresponding latching openings in the intermediate housing.

In accordance with an added mode of the invention, the latching components for guidance of the insulating-piercing terminal contact holders are disposed at equal distances from one another and run virtually at right angles to the axis of the RF cable.

In accordance with an additional mode of the invention, the outer housing is constructed in two parts and the two parts can be engaged with one another through the use of a latching system, so that no tools are required for this assembly step either.

In accordance with yet another mode of the invention, a plurality of RF cables can be disposed alongside one another in an outer housing, as a result of which it is possible to produce a multipole RF connection.

In accordance with yet a further mode of the invention, the application of pressure produces a cold weld between the blades on the insulating-piercing terminal contact holder and the wire braid of the outer conductor of the RF cable. This ensures a reliable electrical connection.

In accordance with a concomitant mode of the invention, the prefabrication of the contact part, of the insulating part and of the insulation-piercing terminal contact holder on the intermediate housing and on the RF cable leads to simplification of assembly, since once pressure has been applied to the insulation-piercing terminal contact holder, all that need be done is final assembly in the outer housing.

Other features which are considered as characteristic for the invention are set forth in the appended claims.

Although the invention is illustrated and described herein as embodied in an RF plug connection system and a method for assembling the RF plug connection system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
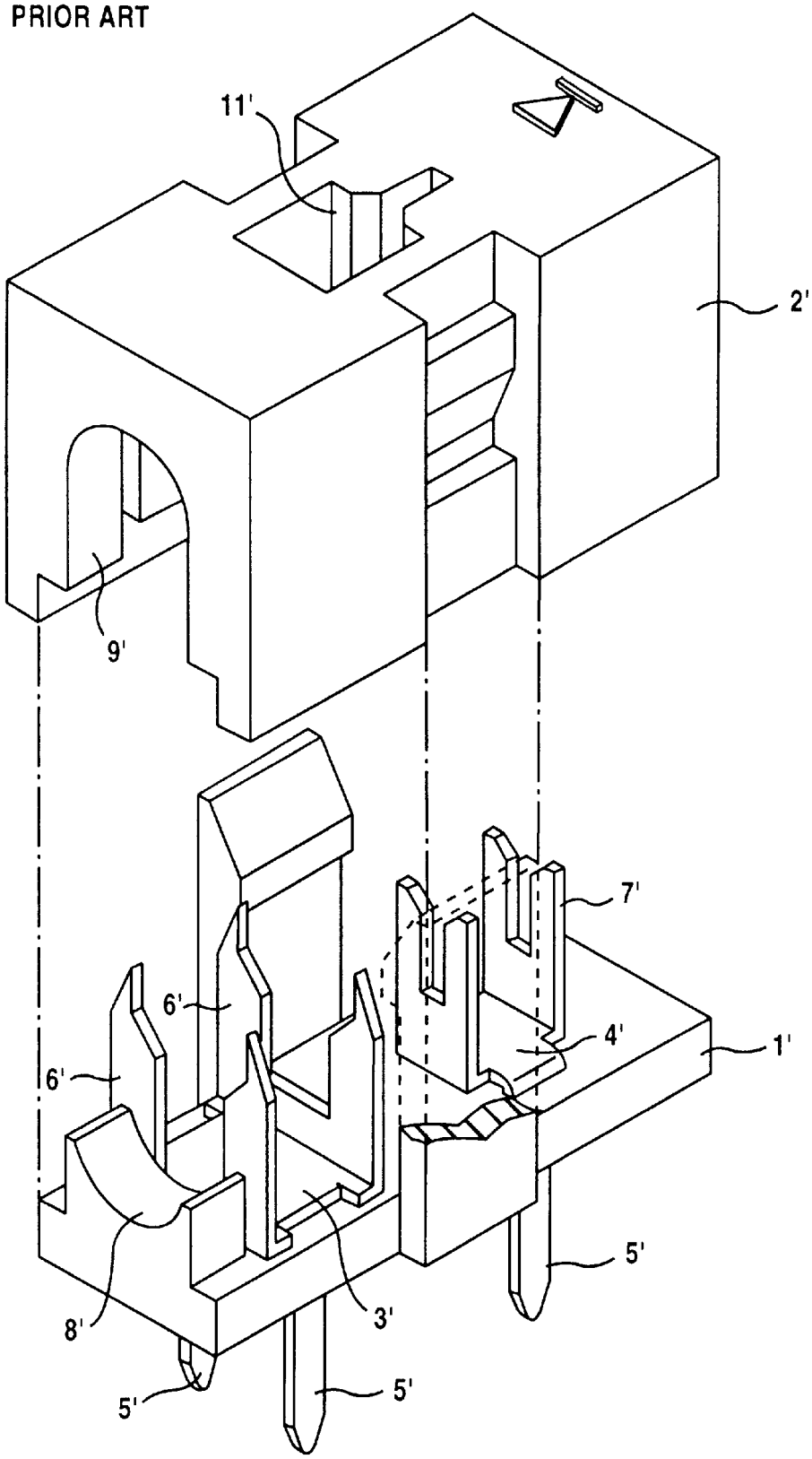
FIG.1 PRIOR ART
FIG. 1 is a fragmentary, diagrammatic, perspective view of an RF connector according to the prior art.
Figure 2:
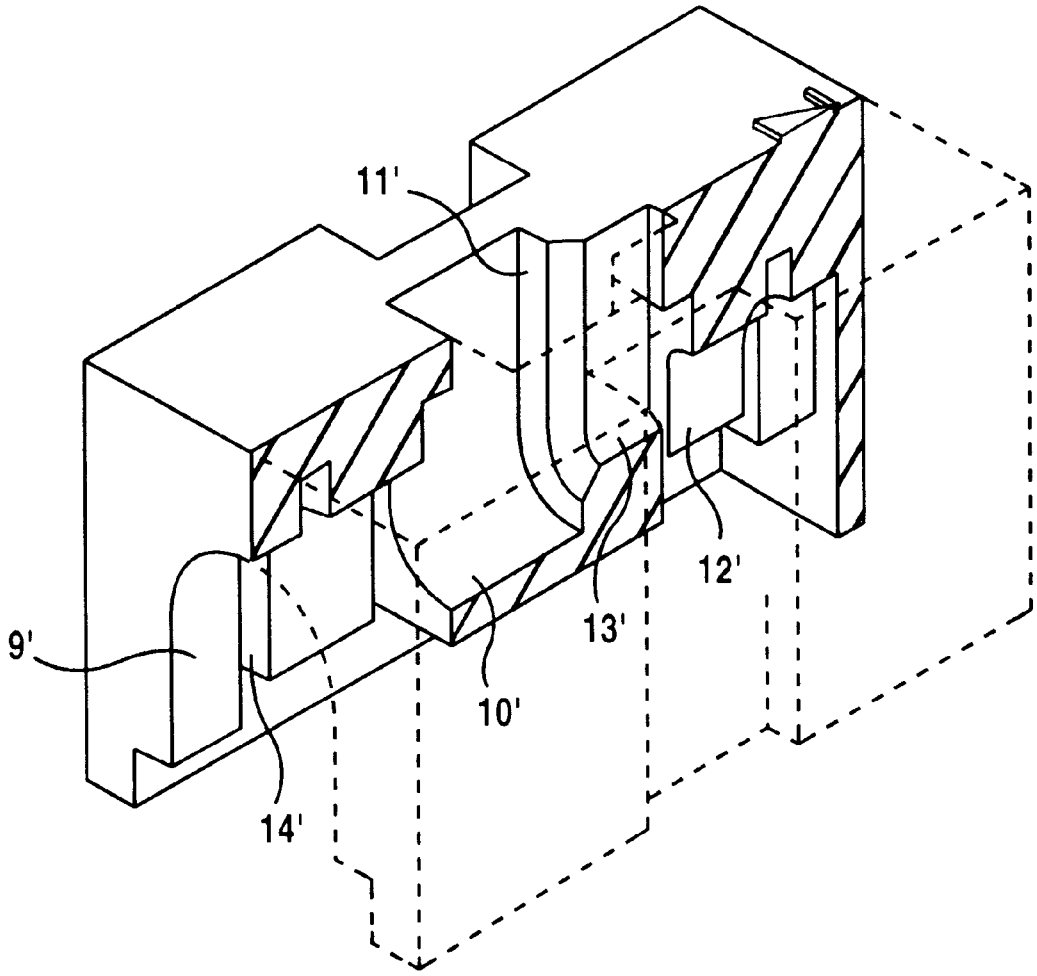
FIG.2 PRIOR ART
FIG. 2 is a partly sectional, further perspective view of the RF connector as shown in FIG. 1.

Referring now to the figures of the drawings in detail and first, particularly, to FIGS. 1 and 2 thereof, there is seen a prior art connector for coaxial cables, according to U.S. Pat. No. 4,701,001. The connector shown therein includes a base part 1 formed of electrically insulating material, first and second contact elements 3', 4' which are fitted to the base part 1', first and second push-on contact devices 6', 7' that displace insulation and a cap-shaped attachment 2' which is formed of electrically insulating material and surrounds the push-on contact devices 6', 7' along with the base part 1' during assembly. The cap-shaped attachment 2' has aligned intermediate spaces for holding a cable end and slots 14' for holding the push-on contact devices 6', 7'. The intermediate spaces have first, second, third and fourth curved inner surfaces 9', 10', 13', 12'.

The first and second contact elements 3', 4' are electrically isolated and run parallel to one another upward, starting from the base part 1' and at right angles thereto. Each first and second contact element 3', 4' has at least one pin 5' at one end which projects downward through the base of the base part 1'. The first push-on contact device 6' is formed at an upper end of the first contact element 3' and extends upward from the base part 1'. The first push-on contact device 6' is constructed in such a manner that it passes through any insulating material which can surround an outer conductor of the cable, in order to make an electrical contact with the outer conductor. The second push-on contact device 7' is formed at an upper end of the second contact element 4' and extends upward from the base part 1'. The second push-on contact device 7' is constructed in such a manner that it passes through an inner sheath and makes electrical contact with an inner conductor.

The four curved inner surfaces 9', 10', 13', 12' of the cap-shaped attachment 2' are spaced apart in the longitudinal direction of the cable, and each has a U-shaped cross section. Curved parts of the first and fourth surfaces 9', 12' point in the direction of the base part 1', and curved parts of the second and third surfaces 10', 13' point away from the base part 1'. The base part 1' has a further curved surface 8' that forms a firm seat in conjunction with the curved part of the first surface 9'. The seat runs completely in the circumferential direction, as a support for the cable. The diameters of the intermediate spaces formed by the first surface 9' and the second surface 10' are essentially equal to the diameters of the intermediate spaces formed by the third surface 13' and fourth surface 12', which are essentially equal to or less than those of the first and second intermediate spaces. Therefore, good support is provided for the different, exposed parts of the cable and the cap-shaped attachment 2' can be detached completely in order to allow easy insertion of the cable end.

Figure 3A:
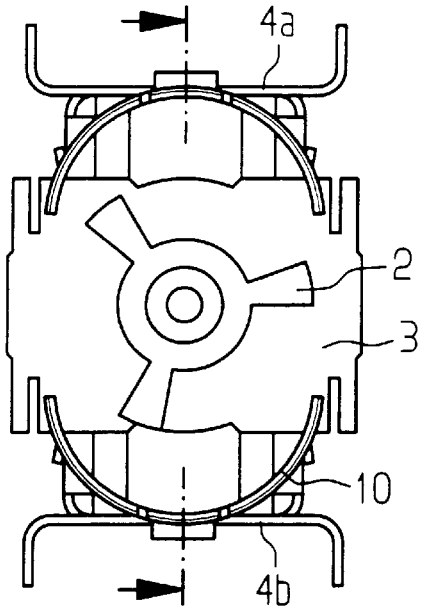
FIGS. 3A–D, 4A–D, 5A–D and 6A–D each include respective front, side, sectional and perspective views of an RF plug connection system according to the invention, showing successive assembly steps.
Figure 3B:
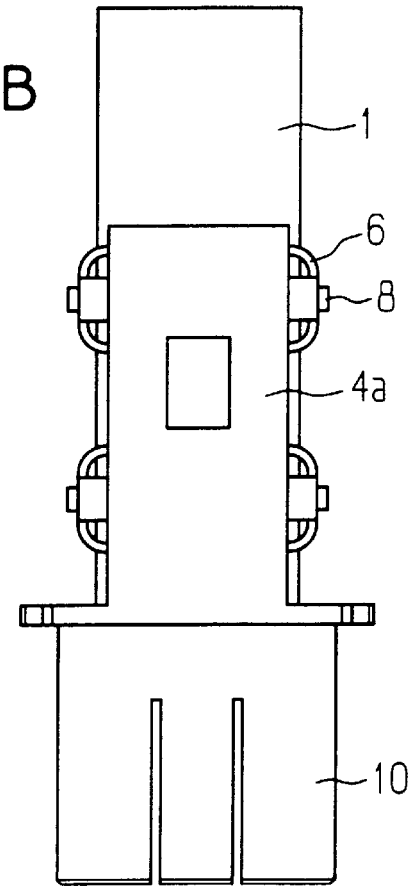
Figure 3C:
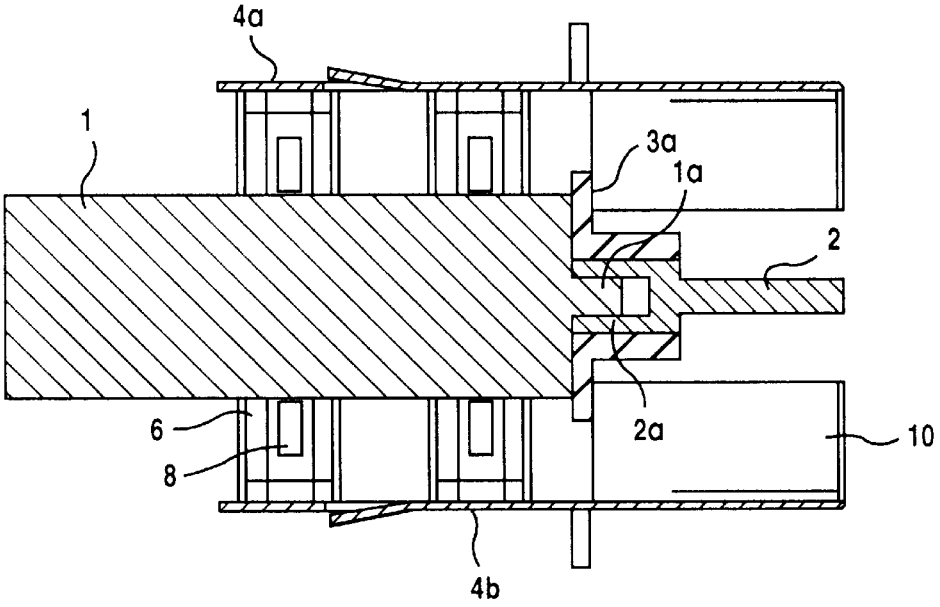
Figure 4C:
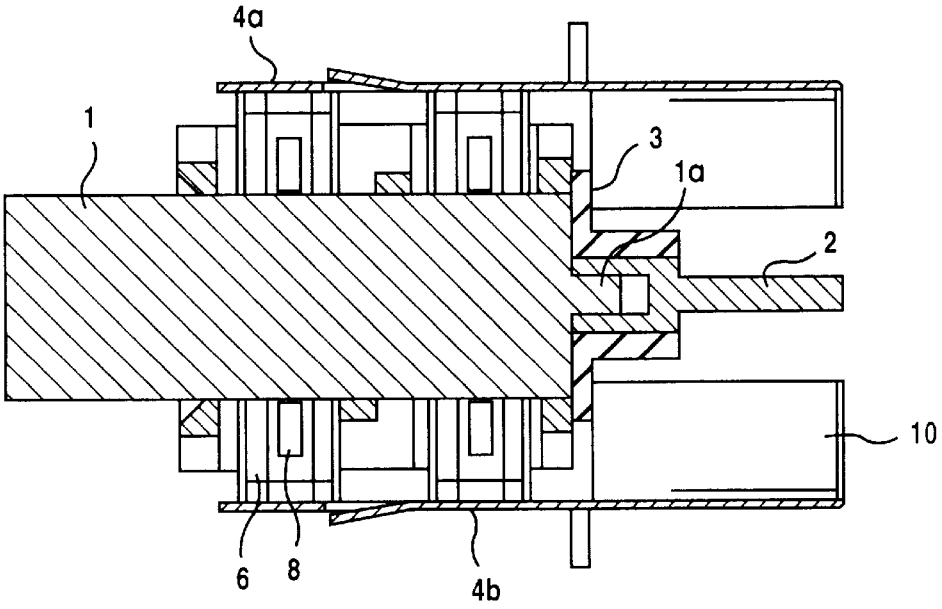

Referring now to the invention, FIG. 3C shows a contact part 2 which is attached, preferably through the use of crimping (alternatively through the use of soldering, etc.) to a free end of an RF conductor 1*a* of an RF cable 1. To this end, the RF cable 1 has its insulation stripped off in an end region, so that the RF conductor 1*a* is exposed over a suitable length, corresponding to a holding section 2*a* of the contact part 2. A cross section of the contact part 2 according to FIG. 3C has a stepped shape. These steps are used for inserting the contact part 2 into an insulating part 3 as far as an insulation 3*a* (for example a component formed of TEFLON). The steps fix the position of the contact part 2 relative to the insulating part 3 shown in FIG. 3A.

FIG. 3A shows a view from the front, in which the contact part 2 is shown with a configuration having three wings. A first insulation-piercing terminal contact holder 4*a* is disposed above the RF cable 1, and a second insulation-piercing terminal contact holder 4*b* is disposed below the RF cable 1. A shielding plate 10 is provided on each of the two insulation-piercing terminal contact holders 4*a* and 4*b*. The shielding plate 10 is in the form of a half-cylindrical sheath that shields an RF conductor part of the contact part 2 when the RF plug connection is in the assembled state.

Figure 3D:
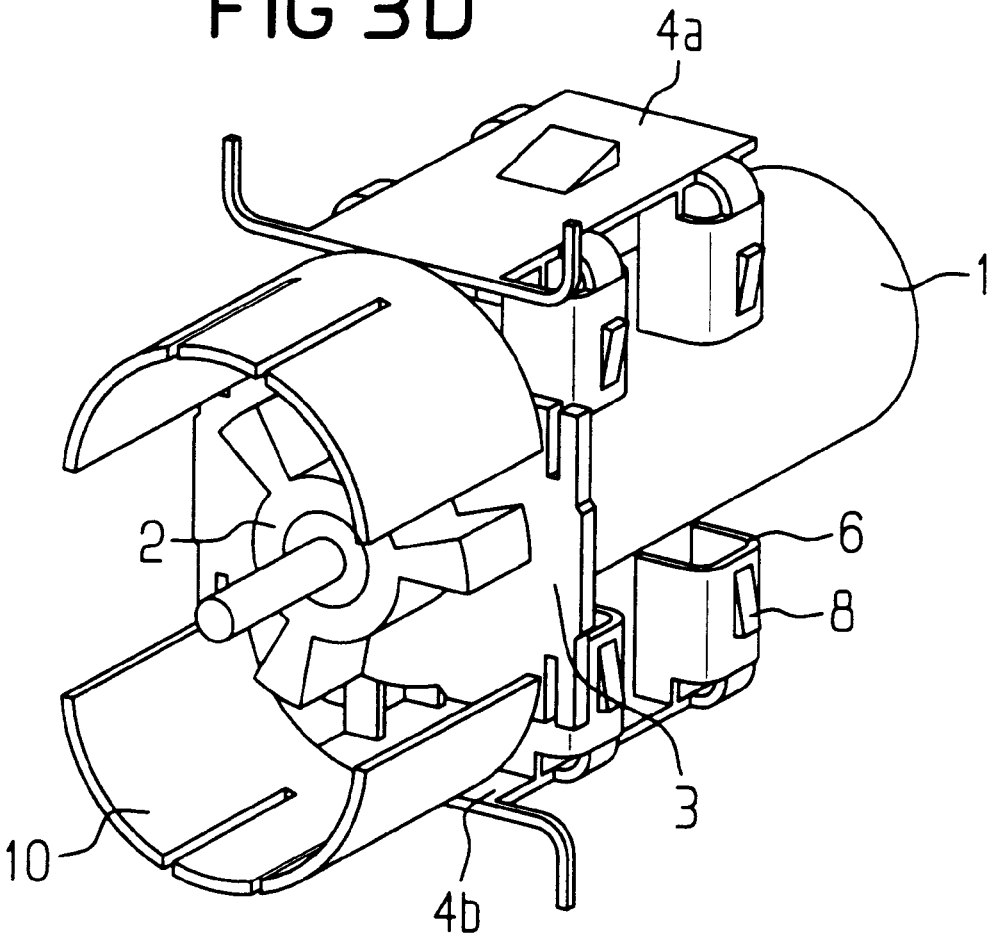

Four blades 6 are preferably provided on each of the insulation-piercing terminal contact holders 4*a* and 4*b*, two on each side with respect to the axis of the RF cable 1, as is shown in FIG. 3B. The blades 6 are constructed with a semicircular or U-shaped cross section, as can be seen in FIG. 3D. Free ends of the U-shaped cross section come into contact with the RF cable 1 in a prefitted state. When the insulation-piercing terminal contact holders 4*a* and 4*b* are pressed or pushed in later, that is to say with a linear displacement in the direction toward the center of the RF cable, these free ends of the U-shaped cross section first of all cut through the outer insulation on the RF cable.

Latching elements 8 are provided in the vicinity of the base section of the U-shaped cross section of the blades 6, and their purpose is described further below.

FIGS. 4A–4D show that an intermediate housing 5 is disposed for guidance and holding of the insulation-piercing terminal contact holders 4*a* and 4*b* and surrounds the insulation-piercing terminal contact holders 4*a* and 4*b*. U-shaped depressions 5*a* are formed internally on the intermediate housing 5, for holding the blades 6 and contributing to their guidance.

Figure 4A:
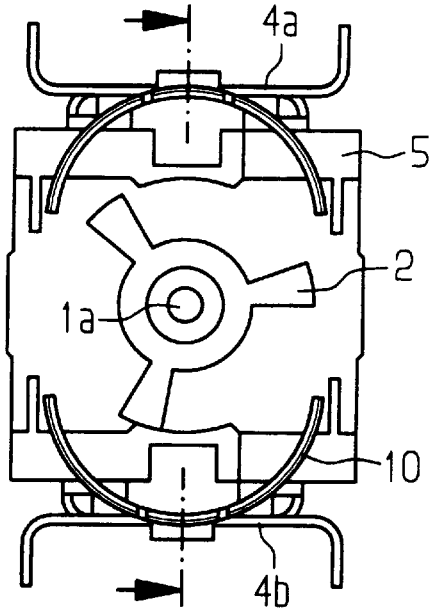
Figure 4B:
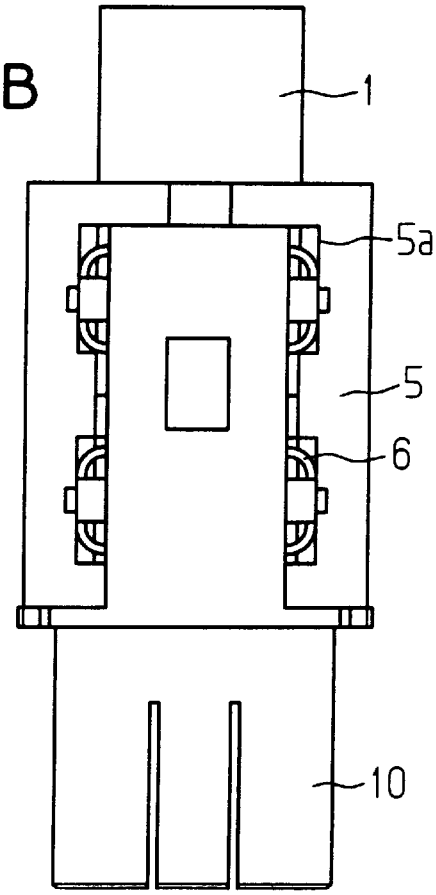
Figure 4D:
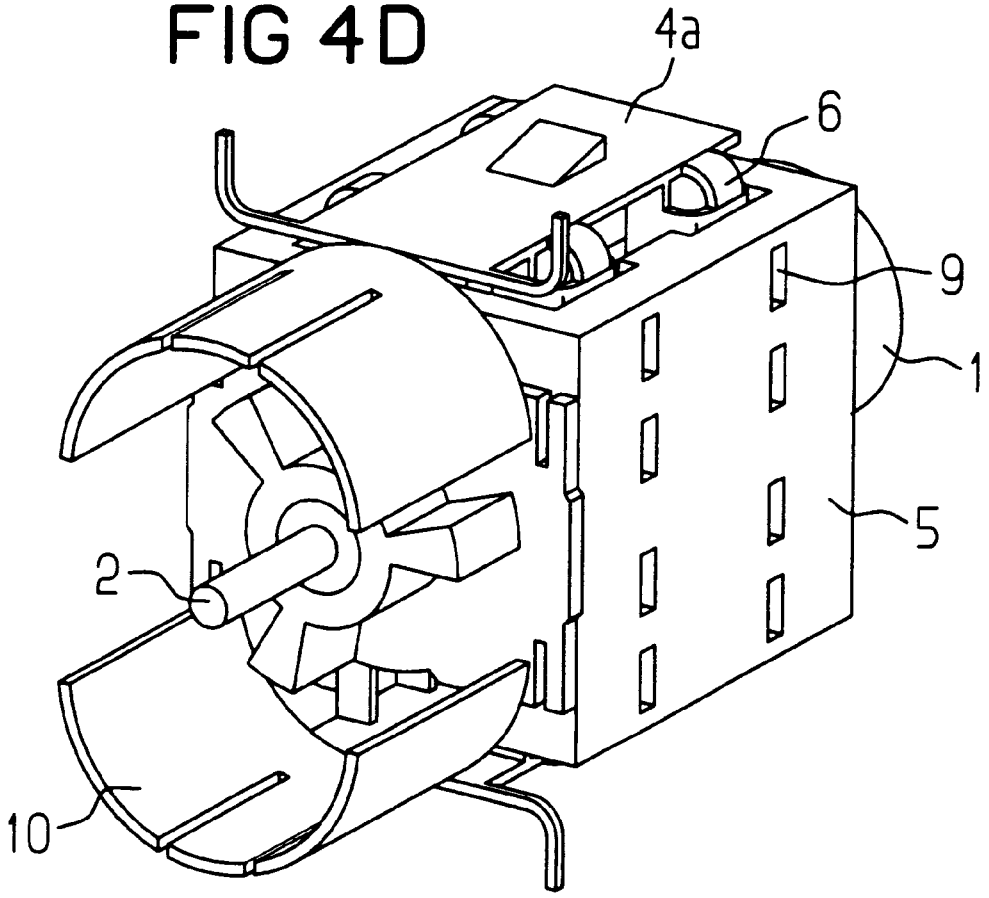
Figure 6C:
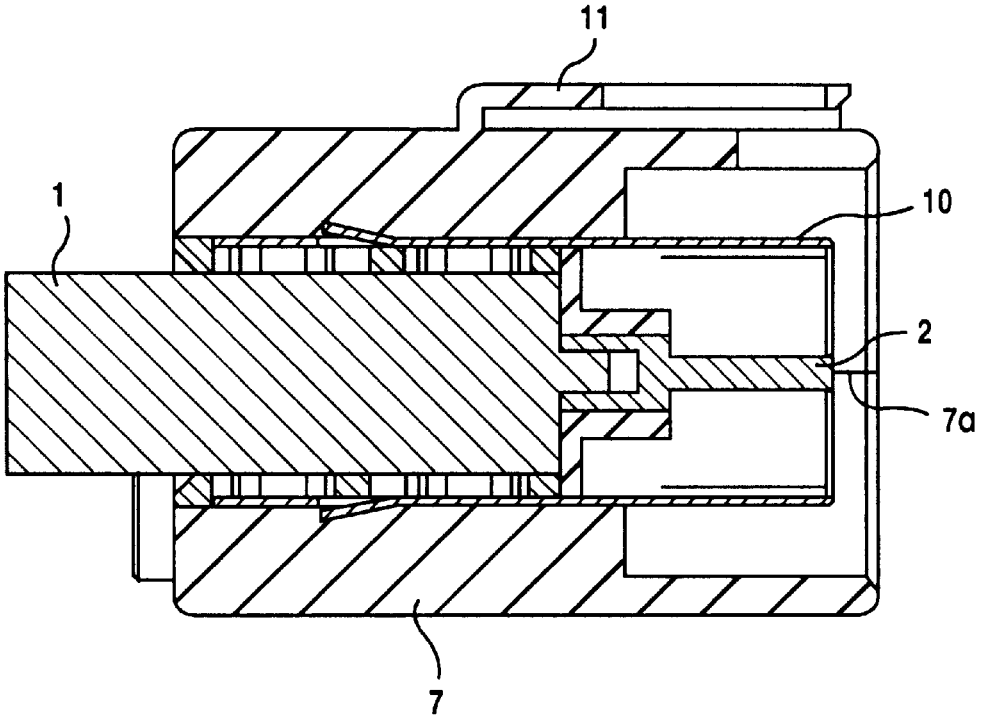

A plurality of latching openings 9 which are located linearly one behind the other in the fitting direction on the intermediate housing in the vicinity of the U-shaped depressions 5*a*, interact with the latching elements 8 on the blades 6. In the assembled state, which is illustrated in FIG. 4D, the latching elements 8 on the blades 6 engage the outer latching openings 9 in the intermediate housing 5.

Figure 5A:
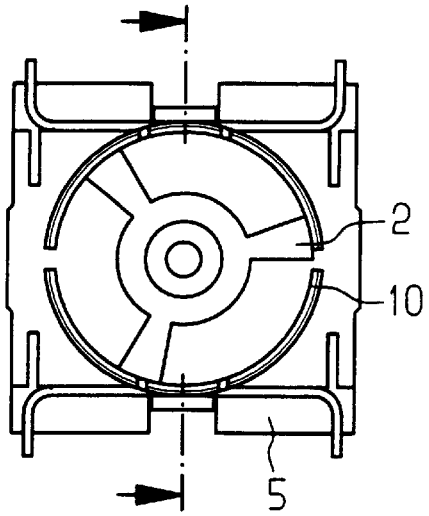
Figure 5B:
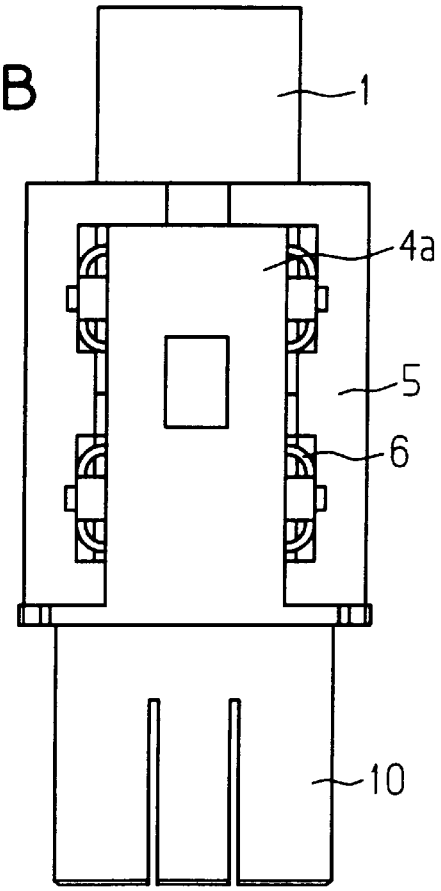
Figure 5C:
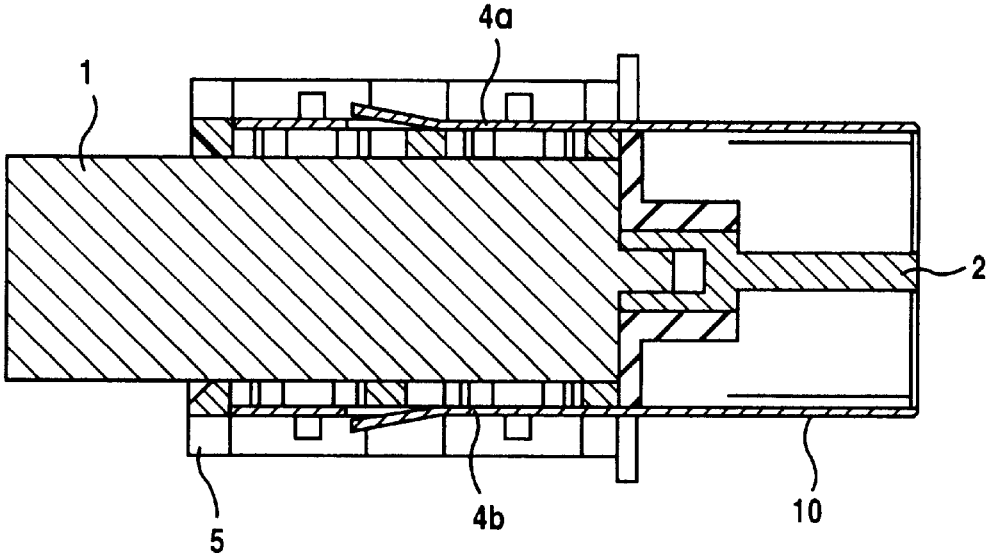
Figure 5D:
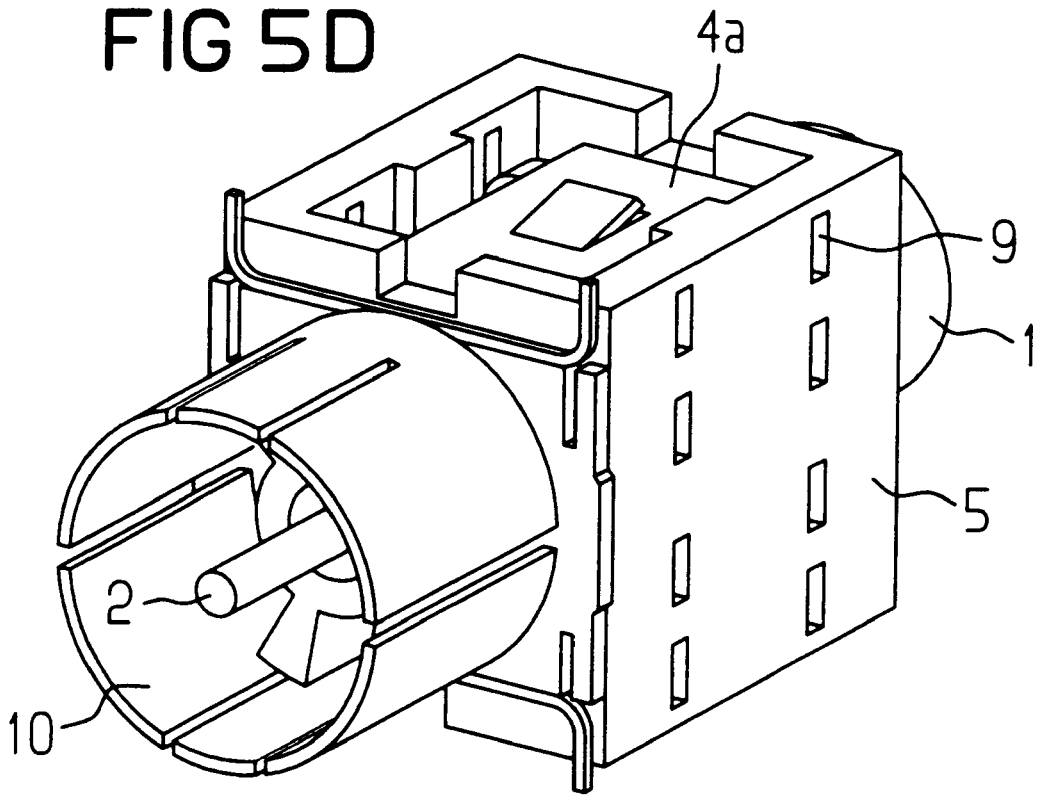

The blades 6 cut into the RF cable 1 and pass through the outer insulation by pushing in and compressing the insulation-piercing terminal contact holders 4*a* and 4*b* relative to the intermediate housing 5. This position of the insulation-piercing terminal contact holders 4*a* and 4*b* is secured by the latching elements 8 latching into the internal latching openings 9 in the intermediate housing 5. This situation is shown in FIG. 5D.

The blades 6 have then cut through the insulation on the RF cable 1, and the outer conductor of the RF cable 1 is pressed between the blades 6, which are opposite one another in pairs. A cold weld is produced between the blades 6 and a wire braid of the outer conductor. The shielding effect of the RF cable is then transferred through an electrically conductive connection to the shielding or screening plates 10.

Finally, FIGS. 6A–6D show the situation that exists once an outer housing 7 has been fitted. The outer housing 7, which is preferably made of two parts, is formed of plastic and has a dividing line 7*a*, is placed over the intermediate housing 5 and is fixed by pressing the two housing halves together, preferably through the use of a latching system. Since the previously described RF plug connection system is preferably used in the motor vehicle sector, the plastic outer housing 7 can be provided with specific features (for example color coding) which simplify use.

Further advantages of the RF plug connection according to the invention are that the blades 6 of the insulation-piercing contact holders 4*a* and 4*b* can be prelatched, thus allowing cost-effective assembly to be achieved. A latching system 11, which includes a button for releasing the connection, is preferably provided for fixing the plug system, that is to say the outer housing 7, in its subsequent environment.

The RF plug connection that has been explained is predominantly formed of plastic parts, so that a weight saving is achieved in comparison with the prior art, and it requires only a very small installation space. The dimensions of the outer housing of the exemplary embodiment are about 13.45×14.09×18.61 mm.

The individual parts of the RF plug connection system can be produced cost-effectively through the use of plastic injection molding and simple bent and stamped parts.

Figure 6A:
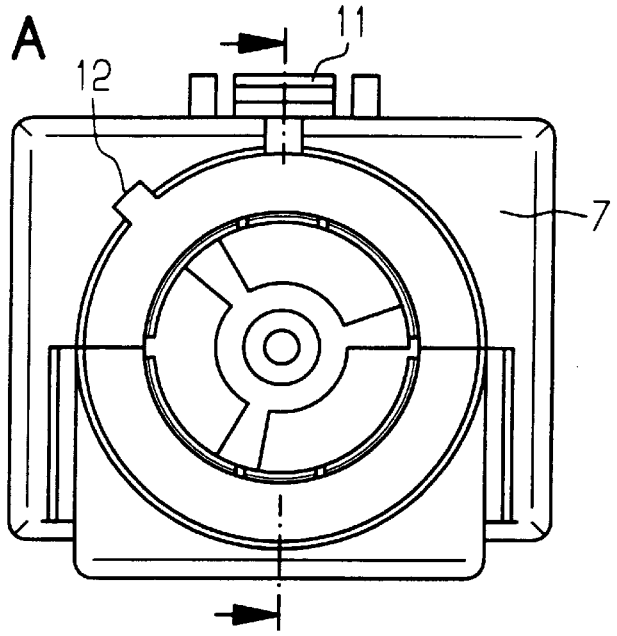
Figure 6B:
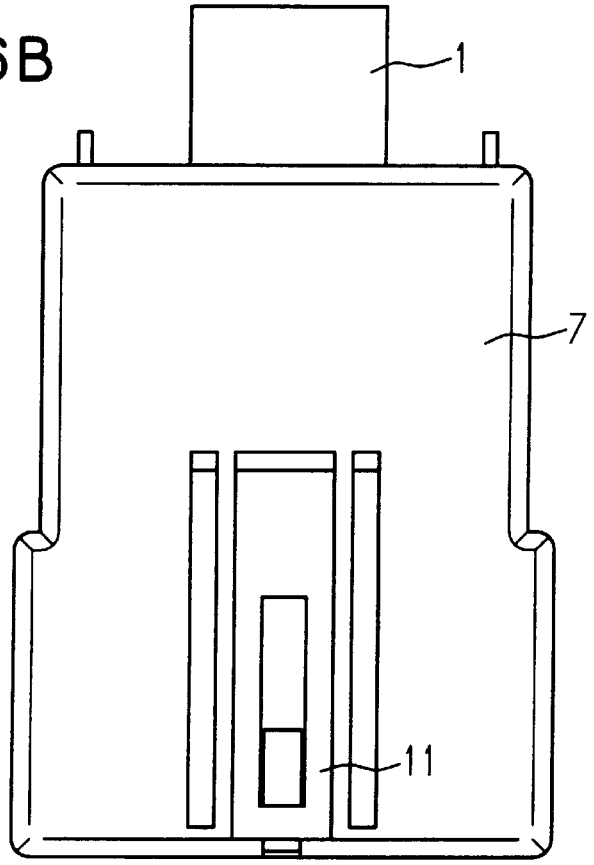
Figure 6D:
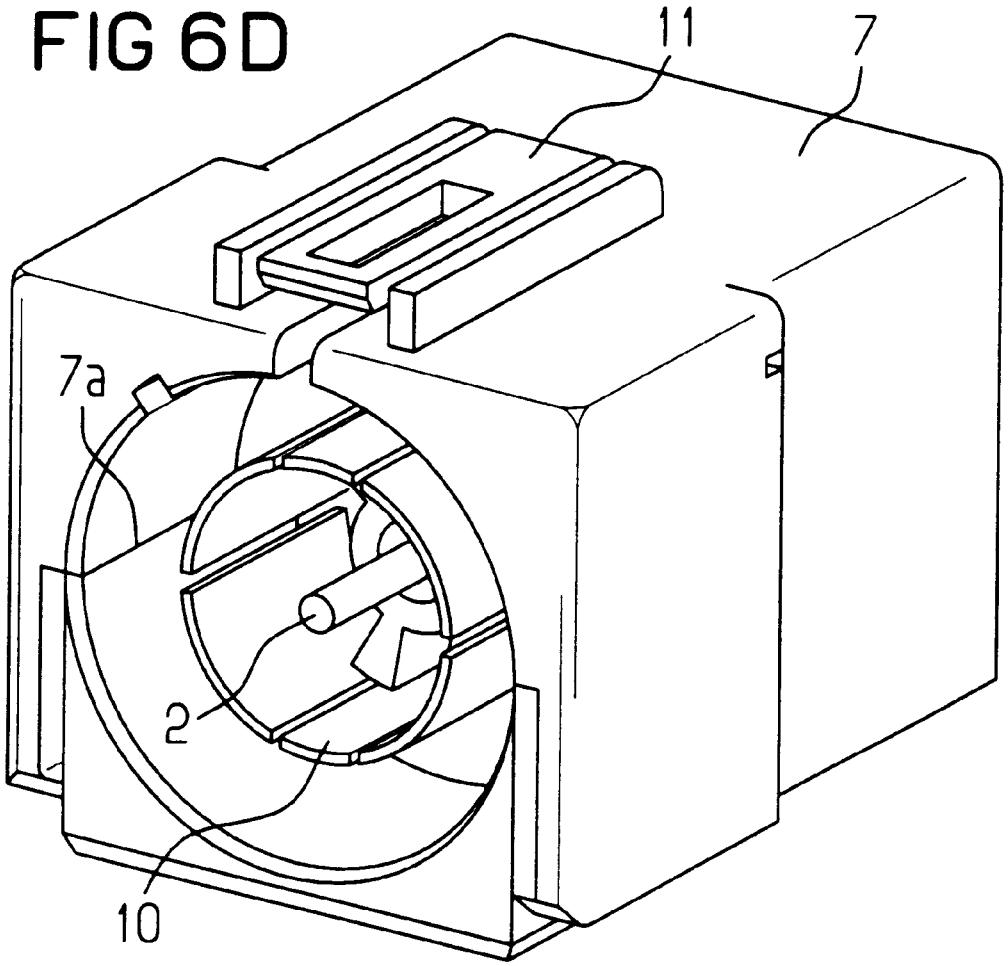

In order to provide a unique assignment of the plugs, a coding 12 seen in FIG. 6A can be provided on the outer housing 7, which precludes incorrect connections.

The proposed plug connection system may be used both as an in-line coupling plug and, through the use of an angled plug connector, for making direct contact on boards.

Finally, a multipole RF cable plug connection can also be provided, in which a plurality of RF plug connection systems are then disposed in a common housing.

We claim:

1. An RF plug connection system, comprising:

a contact part to be electrically conductively fitted to an RF conductor of an RF cable;

an insulating part holding said contact part; an intermediate housing;

at least one piercing terminal contact holder to be disposed on the RF cable and held by said intermediate housing, said at least one piercing terminal contact holder having at least one blade making contact with an outer conductor of the RF cable when said at least one piercing terminal contact holder is pressed against the RF cable;

a plurality of latching openings formed in said intermediate housing substantially at right angles to a longitudinal axis of the RF cable;

said at least one piercing terminal contact holder having a plurality of latching elements to be engaged with said latching openings;

wherein a pressure applied to said at least one piercing terminal contact holder causes each latching element to engage successively in a plurality of said latching openings in a fitting direction of said intermediate housing;

an outer housing disposed on said intermediate housing.

2. The RF plug connection system according to claim 1, wherein said contact part, said insulating part and said at least one piercing terminal contact holder are prefitted in said intermediate housing.

3. The RF plug connection system according to claim 1, wherein said contact part is crimped to the RF conductor.

4. The RF plug connection system according to claim 1, wherein said contact part is soldered to the RF conductor.

5. The RF plug connection system according to claim 1, wherein said intermediate housing is fitted with said at least one piercing terminal contact holder.

6. The RF plug connection system according to claim 1, wherein said contact part is centered in said insulating part.

7. The RF plug connection system according to claim 1, wherein said at least one piercing terminal contact holder has at least one blade with a U-shaped cross section.

8. The RF plug connection system according to claim 1, wherein said insulating part, said intermediate housing and said outer housing are manufactured from plastic.

9. The RF plug connection system according to claim 1, wherein said at least one piercing terminal contact holder is two piercing terminal contact holders.

10. The RF plug connection system according to claim 9, wherein said two piercing terminal contact holders are disposed on diametrically opposite sides of the RF cable.

11. The RF plug connection system according to claim 1, wherein said at least one piercing terminal contact holder has a plurality of blades.

12. The RF plug connection system according to claim 11, wherein said plurality of blades is four blades.

13. The RF plug connection system according to claim 1, wherein said contact part is stepped.

14. The RF plug connection system according to claim 13, wherein said insulating part is stepped, and said stepped contact part is inserted into said correspondingly stepped insulating part for positioning said contact part in a predetermined manner.

15. The RF plug connection system according to claim 1, wherein said at least one piercing terminal contact holder is a plurality of piercing terminal contact holders, and shielding plates in the form of half-cylindrical sheaths are each provided as an outer conductor on said respective piercing terminal contact holder and enclose said contact part in the form of a cylindrical sheath.

16. The RF plug connection system according to claim 15, wherein said piercing terminal contact holders have at least one blade with a U-shaped cross section, and said at least one blade and said shielding plates are electrically conductively connected to one another.

17. A method for assembling an RF plug connection system, which comprises:

a) stripping insulation from an RF cable to expose an RF conductor in the RF cable;

b) connecting the exposed conductor to a contact part;

c) fitting the contact part into an insulating part in an intermediate housing;

d) placing at least one piercing terminal contact holder with at least one blade in the intermediate housing on the RF cable;

e) applying pressure to the at least one piercing terminal contact holder causing the at least one blade to cut through the insulation of the RF cable and make contact with an outer conductor of the RF cable;

f) guiding the at least piercing terminal contact holder in the intermediate housing with a plurality of latching elements formed on the at least one piercing terminal contact holder and engaging corresponding latching openings in the intermediate housing;

g) aligning the plurality of latching elements and the latching openings at a distance from one another and substantially at right angles to a longitudinal axis of the RF cable; and h) fitting an outer housing over the intermediate housing.

18. The method according to claim 17, which comprises carrying out the step of fitting the contact part into the insulating part by using corresponding steps on the contact part and the insulating part.

19. The method according to claim 17, which comprises producing a cold weld between the at least one blade and a wire braid of the outer conductor of the RF cable.

20. The method according to claim 17, which comprises prefitting the contact part with the RF cable, the insulating part and the at least one piercing terminal contact holder in the intermediate housing, and finally fitting the intermediate housing in the outer housing once pressure has been applied to the at least one piercing terminal contact holder.

* * * * *